US007107737B2

(12) United States Patent
Spatafora

(10) Patent No.: US 7,107,737 B2
(45) Date of Patent: Sep. 19, 2006

(54) MACHINE AND METHOD FOR PRODUCING A PACKAGE BY FOLDING A SHEET OF PACKING MATERIAL ABOUT A RESPECTIVE ARTICLE

(75) Inventor: Mario Spatafora, Granarolo (IT)

(73) Assignee: G. D Societa' per Azioni, Bologna (IT)

( * ) Notice: Subject to any disclaimer, the term of this patent is extended or adjusted under 35 U.S.C. 154(b) by 76 days.

(21) Appl. No.: 10/996,748

(22) Filed: Nov. 24, 2004

(65) Prior Publication Data

US 2005/0126128 A1 Jun. 16, 2005

(30) Foreign Application Priority Data

Nov. 24, 2003 (IT) ..... BO2003A0710

(51) Int. Cl.
*B65B 11/28* (2006.01)

(52) U.S. Cl. ..... 53/234; 53/233; 53/228

(58) Field of Classification Search ..... 53/461, 53/466, 228, 232, 233, 234; 156/359, 578; 335/205, 206, 207
See application file for complete search history.

(56) References Cited

U.S. PATENT DOCUMENTS 3,419,731 A * 12/1968 Wheable et al. ..... 335/206
3,441,691 A * 4/1969 Dion et al. ..... 335/206
3,735,298 A * 5/1973 Colby ..... 335/206
4,137,512 A * 1/1979 Sidor ..... 335/206
4,389,627 A * 6/1983 Uesugi et al. ..... 335/206
5,467,579 A * 11/1995 Boriani et al. ..... 53/234
6,263,644 B1 * 7/2001 Ghini et al. ..... 53/234
6,438,927 B1 * 8/2002 Focke et al. ..... 53/415
6,698,158 B1 * 3/2004 Spatafora ..... 53/234
6,824,614 B1 * 11/2004 Spatafora ..... 156/578

FOREIGN PATENT DOCUMENTS

DE 42 20 376 12/1992
EP 1 142 788 10/2001

OTHER PUBLICATIONS

English Abstract of DE 42 20 376 dated Dec. 23, 1992.

* cited by examiner

*Primary Examiner*—Louis Huynh
(74) *Attorney, Agent, or Firm*—Ladas & Parry LLP

(57) ABSTRACT

A machine and method for producing a package by folding a sheet of packing material about a respective article; a packing conveyor feeds along a packing path a folding head, which houses the package and has an electrically heated activating member for applying heat to a portion of the package; the folding head also has a movable magnetic core, which has a coil connected electrically to the activating member, and is positioned facing and coupled magnetically to a fixed magnetic core positioned parallel to the packing path; in use, a coil coupled to the fixed magnetic core is supplied with electric current to induce flow of a corresponding electric current through the coil of the movable magnetic core.

10 Claims, 4 Drawing Sheets

MACHINE AND METHOD FOR PRODUCING A PACKAGE BY FOLDING A SHEET OF PACKING MATERIAL ABOUT A RESPECTIVE ARTICLE

The present invention relates to a machine and method for producing a package by folding a sheet of packing material about a respective article.

BACKGROUND OF THE INVENTION

On a packing machine, each article is fed by a succession of packing conveyors along a packing path to be paired with a respective sheet of packing material, which is subsequently folded about the article to define a package. The package must be stabilized by permanently joining, by gluing or heat sealing, overlapping portions of the sheet of packing material. More specifically, when gluing is employed, a layer of glue is deposited on a number of portions of the sheet of packing material before the sheet of packing material is folded about the article.

Hot-melt glue, i.e. glue which is solid at ambient temperature and becomes fluid when heated, is known to be applied to the sheet of packing material long before the sheet of packing material is folded about the article, so as to allow the spots of glue on the flat sheet of packing material to set; and, once the package is completed by folding the sheet of packing material about the article, the spots of glue deposited beforehand are reactivated, i.e. melted, by heating the portions of the package at the glue spots. The above method of reactivating the glue spots after the package is completed has the advantage of enabling the gumming devices to be set up in the best location (i.e. for easy access and cleaning) and not necessarily immediately upstream from the folding members where space is normally limited. Moreover, in the event of temporary stoppage of the machine, the sheets of packing material on which glue has already been deposited, and which have not yet been folded, do not result in faulty packages when the machine is started up again.

On the other hand, reactivating the glue spots after the package is completed complicates the structure of the packing conveyors, in that the seats on the packing conveyors carrying the packages must be provided with heating members to heat the packages at the glue spots. Normally, a packing conveyor seat is equipped with electric resistors, which are powered by a fixed external electric power supply by means of brushes integral with the packing conveyor and which slide over a fixed contact positioned parallel to the path of the packing conveyor. This solution has the drawback of requiring periodic replacement of the brushes, which wear out relatively fast.

It has also been proposed to heat the heating members by magnetic induction. Such a method, however, cannot be used for packages comprising sheets of metalized packing material, in that the magnetic flux for heating the heating members tends to also heat and irreparably damage the sheets of metalized packing material.

SUMMARY OF THE INVENTION

It is an object of the present invention to provide a machine and method for producing a package by folding a sheet of packing material about a respective article, designed to eliminate the aforementioned drawbacks, and which, in particular, are cheap and easy to implement.

According to the present invention, there is provided a packing machine for producing a package by folding a sheet of packing material about a respective article; the packing machine comprising a conveyor having at least one seat, which feeds the package along a packing path, and has at least one electrically heatable activating member for applying heat to a portion of the package; the packing machine being characterized by comprising a number of fixed first magnetic cores, each having a respective first coil and positioned parallel to the conveyor along a portion of the packing path; the seat comprising a respective movable second magnetic core, which has a second coil connected electrically to the activating member, and is positioned facing and coupled magnetically to the fixed first magnetic cores; a power supply device being provided, which, in use, supplies the first coils with a first electric current to induce flow of a corresponding second electric current through the second coil.

According to the present invention, there is also provided a packing machine for producing a package by folding a sheet of packing material about a respective article; the packing machine comprising a packing conveyor having a seat, which feeds the package along a packing path, and has a movable folding device which is movable into a position contacting a wall of the article to fold a portion of the sheet of packing material onto the wall of the article; a gumming unit located upstream from the packing conveyor and for gumming the sheet of packing material by applying hot-melt glue; and an electrically heatable activating member for heating the package to reactivate the glue; the packing machine being characterized in that the activating member is carried by the folding device and has a low thermal inertia, so that, each time it travels along the packing path, the activating member has a first temperature when electric current flows through the activating member, and a second temperature, much lower than the first temperature and close to ambient temperature, when no electric current flows through the activating member; the folding device being moved into contact with the sheet of packing material when the activating member is at the second temperature; the folding device being moved into contact with the wall of the article to fold a portion of the sheet of packing material onto the wall of the article; the activating member being heated electrically, so that the activating member assumes the first temperature long enough to reactivate the glue; electric power supply being cut off from the activating member to restore the activating member to the second temperature and allow the glue to set once more; and, finally, the package being released from the seat.

According to the present invention, there is provided a method of producing a package by folding a sheet of packing material about a respective article; the method comprising gumming the sheet of packing material by applying hot-melt glue; feeding the package along a packing path; moving a movable folding device into a position contacting a wall of the article to fold a portion of the sheet of packing material onto the wall of the article; and heating the package to reactivate the glue by means of an electrically heatable activating member; the method being characterized in that the activating member is carried by the folding device and has a low thermal inertia, so that, each time it travels along the packing path, the activating member has a first temperature when electric current flows through the activating member, and a second temperature, much lower than the first temperature and close to ambient temperature, when no electric current flows through the activating member; the method comprising moving the folding device into contact with the sheet of packing material when the activating member is at the second temperature; moving the folding device into contact with the wall of the article to fold a portion of the sheet of packing material onto the wall of the article; heating the activating member electrically, so that the activating member assumes the first temperature long enough to reactivate the glue; cutting off electric power supply to the activating member to restore the activating member to the second temperature and allow the glue to set once more; and, finally, removing the package from the seat.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
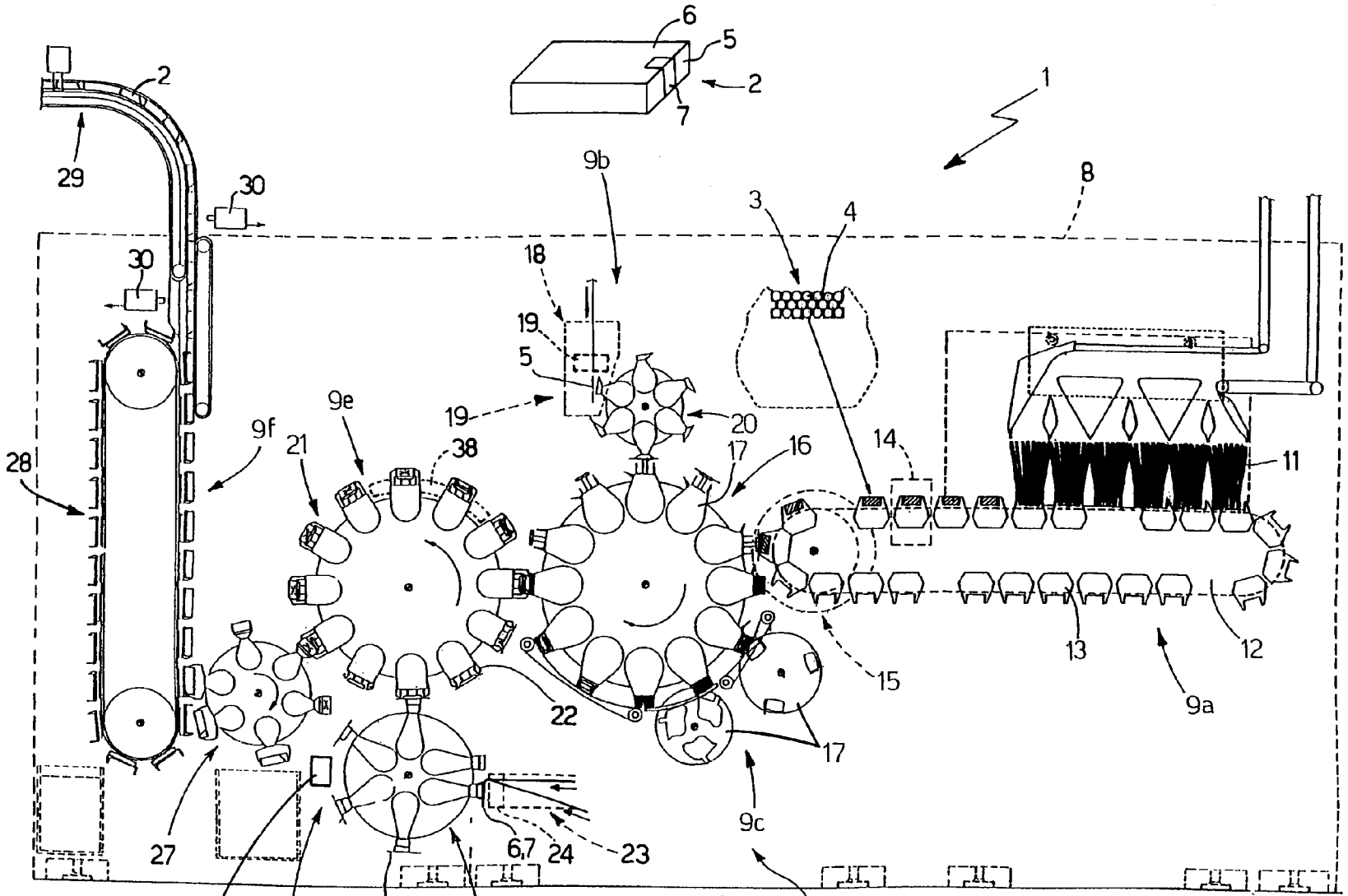
FIG. 1 shows a schematic front view of an automatic cigarette packing machine in accordance with the present invention.

Number 1 in FIG. 1 indicates as a whole an automatic machine for producing soft packets 2 of cigarettes. Each packet 2 comprises an orderly group 3 of cigarettes 4 wrapped in a sheet 5 of foil; an outer sheet 6 of packing material is folded cup-fashion about group 3 of cigarettes 4 wrapped in sheet 5 of foil; and an inland revenue stamp 7 is preferably applied crosswise on sheet 6 of packing material.

Machine 1 is substantially known, and comprises a frame 8 shown by a dash line in FIG. 1 and supporting a number of work stations 9 located along a production line and each having a respective number of operating devices 10. More specifically, machine 1 comprises six work stations 9 : a station 9*a* for forming groups 3 of cigarettes 4; a station 9*b* for supplying sheets 5 of foil; a station 9*c* for folding sheets 5 of foil about respective groups 3 of cigarettes; a station 9*d* for supplying sheets 6 of packing material and inland revenue stamps 7; a station 9*e* for folding sheets 6 of packing material and inland revenue stamps 7 about respective groups 3 of cigarettes (and over sheets 5 of foil); and a station 9*f* for drying packets 2.

The main operating devices 10 of each work station 9 will now be described by way of example with reference to FIG. 1, though, obviously, each work station in actual fact normally comprises a larger number of operating devices (in particular, control sensors) which the schematic nature of FIG. 1 does not permit to show in detail.

Station 9*a* for forming groups 3 of cigarettes 4 comprises a hopper 11 for supplying cigarettes 4; a conveyor 12 with trains of pockets 13, each for receiving a respective group 3 of cigarettes 4; optical control devices 14; and a transfer wheel 15.

Station 9*c* for folding sheets 5 of foil about respective groups 3 of cigarettes comprises a packing wheel 16 having a number of folding heads 17, each for receiving a respective group 3 of cigarettes from transfer wheel 15, and a respective sheet 5 of foil from supply station 9*b*, and for folding sheet 5 of foil about group 3.

Station 9*b* for supplying sheets 5 of foil comprises a feed conveyor 18; a cutting device 19; and a feed wheel 20 for feeding sheets 5 of foil to packing wheel 16.

Station 9*e* for folding sheets 6 of packing material and inland revenue stamps 7 about respective groups 3 of cigarettes (and over sheets 5 of foil) comprises a packing wheel 21 having a number of folding heads 22, each for receiving a respective sheet 6 of packing material and an inland revenue stamp 7 from supply station 9*d*, for receiving a respective group 3 from packing wheel 16, and for folding sheet 6 of packing material and inland revenue stamp 7 about group 3 of cigarettes.

Station 9*d* for supplying sheets 6 of packing material and inland revenue stamps 7 comprises a feed conveyor 23; a cutting device 24; and a feed wheel 25 for feeding sheets 6 of packing material and inland revenue stamps 7 to packing wheel 21. A gumming device 26 is also located at supply station 9*d* to deposit a number of spots or areas of thermoplastic (or hot-melt) glue on each flat sheet 6 of packing material and on each flat inland revenue stamp 7.

Finally, station 9f for drying packets 2 comprises a transfer and reject wheel 27; a drying conveyor 28; an output conveyor 29; and optical control devices 30.

In actual use, as packing wheel 21 rotates continuously about a central axis perpendicular to the FIG. 1 plane, each packing head 22 is fed cyclically along a circular packing path, along which packing head 22 receives a respective sheet 6 of packing material and an inland revenue stamp 7 from supply station 9*d*, receives a respective group 3 of cigarettes from packing wheel 16, and folds sheet 6 of packing material and inland revenue stamp 7 about group 3 of cigarettes. Each sheet 6 of packing material and the respective inland revenue stamp 7 are gummed with thermoplastic (or hot-melt) glue by gumming device 26 before being fed to packing wheel 21, i.e. gumming device 26 deposits on each sheet 6 of packing material and on the respective inland revenue stamp 7 a number of spots and/or bands of thermoplastic glue on the overlap areas of sheet 6 of packing material and inland revenue stamp 7. Before each sheet 6 of packing material and the respective inland revenue stamp 7 are folded about group 3 of cigarettes, the thermoplastic glue deposited by gumming device 26 sets on cooling and so becomes ineffective. And, once each sheet 6 of packing material and the respective inland revenue stamp 7 are folded about group 3 of cigarettes, heat is applied to respective packet 2 to heat the thermoplastic glue on sheet 6 of packing material and on inland revenue stamp 7, and so reactivate and restore the thermoplastic glue to the liquid or semiliquid state; and the thermoplastic glue eventually cools once more to stabilize the folded position of sheet 6 of packing material and inland revenue stamp 7.

Figure 2:
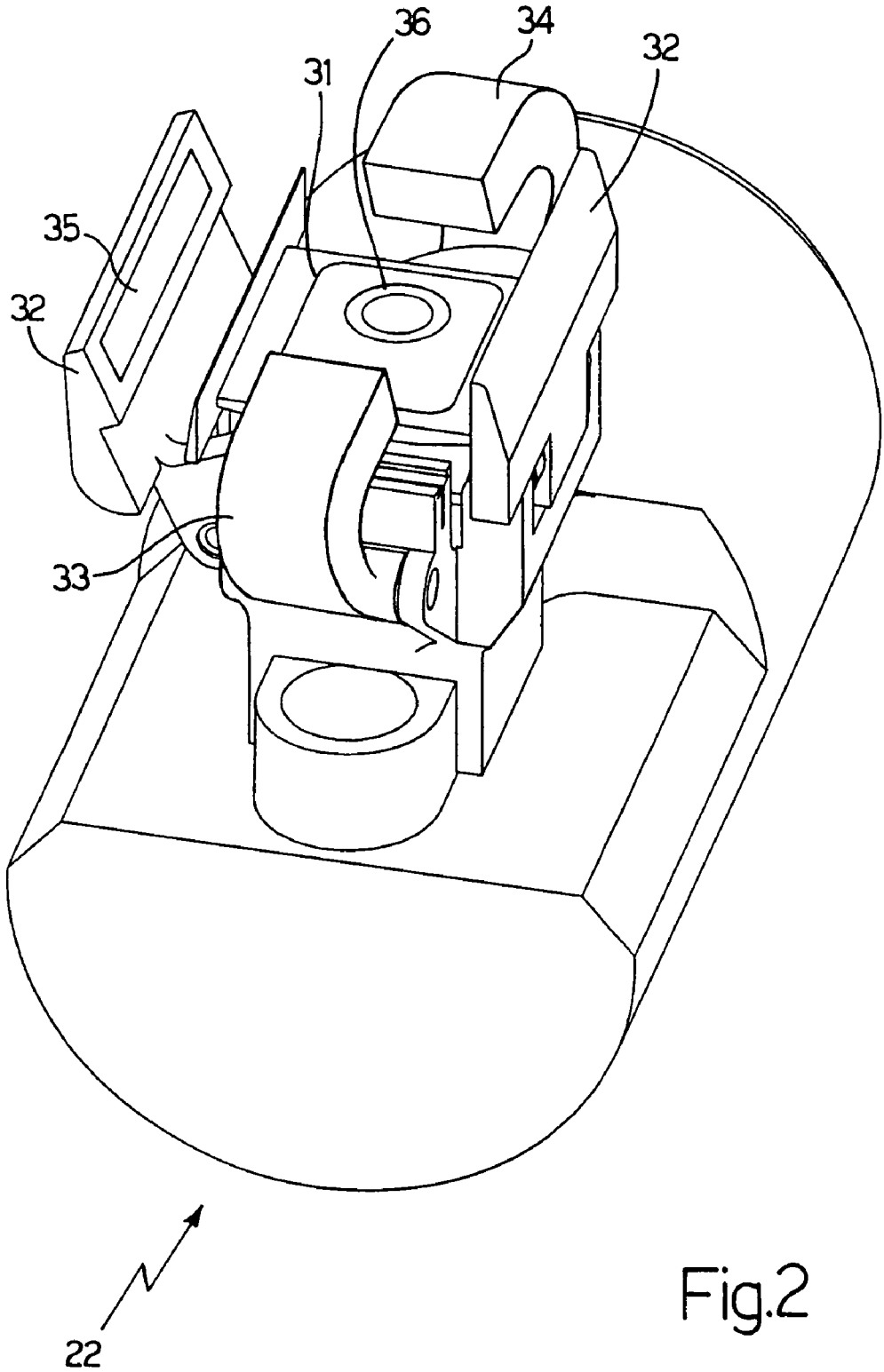
FIG. 2 shows a view in perspective, with parts removed for clarity, of a folding head forming part of a packing wheel of the FIG. 1 machine.

FIG. 2 shows, schematically, with parts removed for clarity, one of folding heads 22 on packing wheel 21. Folding head 22 comprises a seat defined by a suction plate 31 and for housing a respective group 3 of cigarettes together with the corresponding sheet 6 of packing material and inland revenue stamp 7, so as to fold sheet 6 of packing material and inland revenue stamp 7 about group 3 of cigarettes. Suction plate 31 is surrounded by two lateral folding devices 32 hinged to folding head 22, facing each other on opposite sides of suction plate 31, and for folding sheet 6 of packing material laterally onto group 3 of cigarettes to define a tubular wrapping; and by two end folding devices 33, 34 hinged to folding head 22 and facing each other on opposite sides of suction plate 31. End folding device 33 provides for finish-folding the end of sheet 6 of packing material, and end folding device 34 for folding inland revenue stamp 7 onto group 3 of cigarettes.

Figure 3:
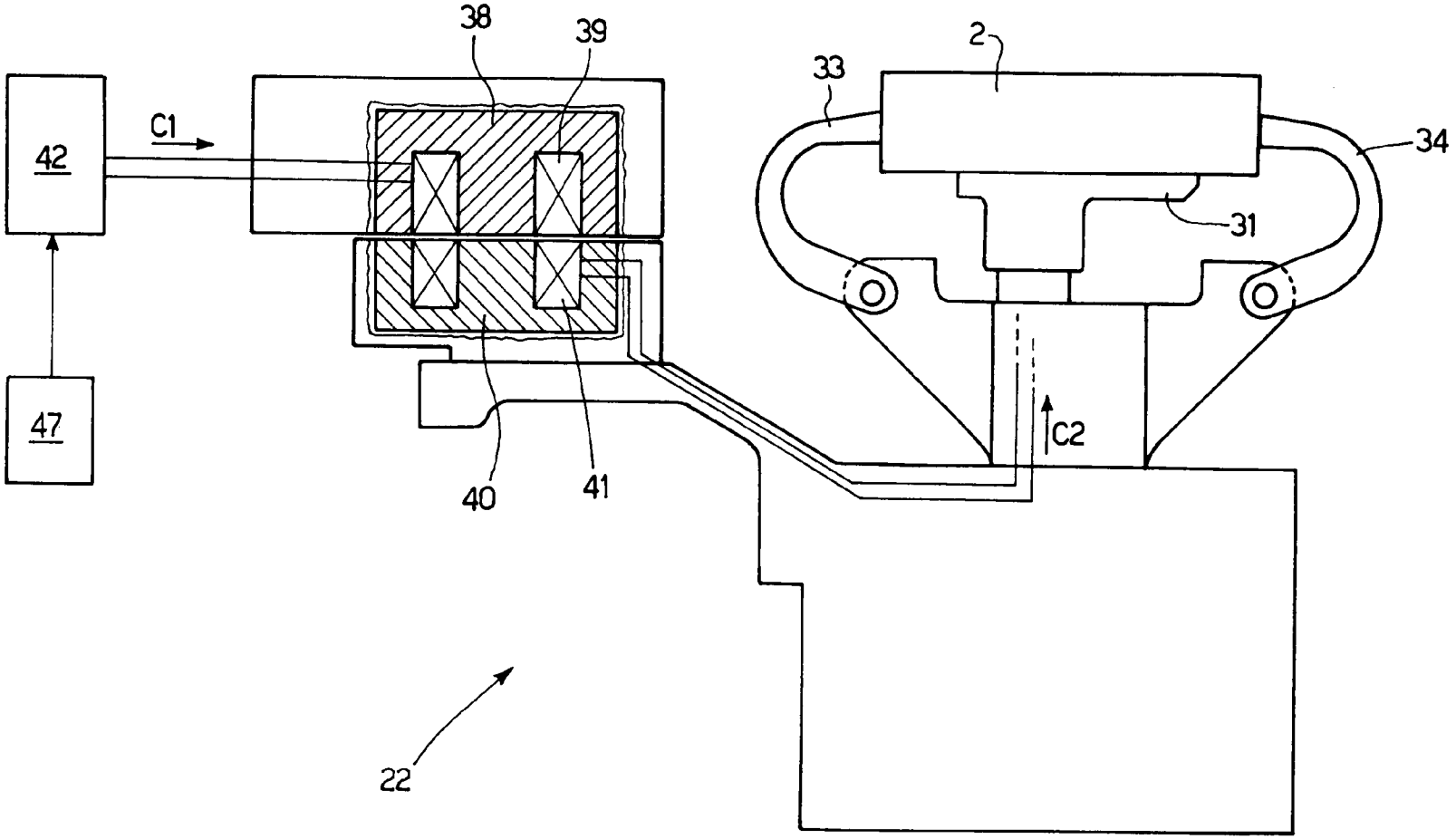
FIG. 3 shows a schematic side view of the FIG. 2 folding head.

As shown in FIGS. 2 and 3, one lateral folding device 32, which in use is positioned contacting a lateral overlap portion of sheet 6 of packing material, has an activating member 35, which is heated electrically to apply heat to a corresponding portion of packet 2; suction plate 31 has an activating member 36 located at the position assumed by inland revenue stamp 7, and which is heated electrically to apply heat to packet 2; and end folding device 33, which is positioned in use contacting the end fold in sheet 6 of packing material, has an activating member 37 (FIG. 4), which is heated electrically to apply heat to a corresponding portion of packet 2.

As shown in FIG. 3, a number of fixed magnetic cores 38 are located about packing wheel 21, and each comprises a coil 39 and is located, parallel to packing wheel 21, along a portion of the packing path travelled by folding heads 22 as packing wheel 21 rotates continuously. Consequently, and as shown clearly in FIG. 1, magnetic cores 38 are in the form of an arc extending about and close to packing wheel 21. Each folding head 22 comprises a respective movable magnetic core 40 having a coil 41 and facing and coupled magnetically to fixed magnetic cores 38; and each coil 41 is connected electrically to, and electrically supplies, respective activating members 35, 36, 37.

In actual use, a power supply device 42, connected to coils 39 of fixed magnetic cores 38, supplies coils 39 with alternating voltage, so that an alternating electric current C1 flows through coils 39 and generates magnetic flux, which flows through both fixed magnetic cores 38 and movable magnetic cores 40 and is linked to relative coils 41. Each coil 41 is thus linked to a time-variable magnetic flux, so that a corresponding alternating voltage is induced in coil 41 and causes alternating electric current C2 to flow through coils 41. It is important to note that the magnetic flux linked to coils 41 varies with time by being generated by an alternating electric current C1 (i.e. time-variable by definition) and also by virtue of the movement of movable magnetic cores 40 with respect to fixed magnetic cores 38.

The alternating electric current C2 flowing through each coil 41 also involves respective activating members 35, 36, 37, which therefore produce heat which is yielded to relative packet 2.

In other words, coils 39 and coils 41 act like the primary and secondary of an electric transformer, the magnetic core of which is divided into a fixed part (fixed magnetic cores 38), and a movable part (movable magnetic cores 40) facing the fixed part. Obviously, the inevitable gap between fixed magnetic cores 38 and movable magnetic cores 40 reduces the efficiency with which electric energy is transmitted between coils 39 and coils 41, as compared with the high efficiency (90–95%) of a conventional transformer, but the reduction is negligible given the small amount of electric power involved.

In the FIG. 3 embodiment, activating members 35, 36, 37 are all connected to the same coil 41 and therefore supplied together. Obviously, the amount of heat generated may be distributed unevenly by forming activating members 35, 36, 37 with different electric resistances (being heating bodies, the electric resistance substantially coincides with the corresponding electric impedance). More specifically, the activating member 35, 36, 37 with the lowest electric resistance generates more heat in the case of a parallel electric connection, and generates less heat in the case of a series electric connection.

Another embodiment may comprise a number of movable magnetic cores 40, which supply corresponding activating members 35, 36, 37 by means of respective coils 41, and are connected to the same group of fixed magnetic cores 38, or may comprise a number of movable magnetic cores 40, which supply corresponding activating members 35, 36, 37 by means of respective coils 41, and are connected to respective independent groups of fixed magnetic cores 38. For example, in the FIG. 4 embodiment, activating member 37 is supplied by coil 41 of a respective magnetic core 40, which is different from and independent of the magnetic core 40 supplying activating members 35 and 36, and is connected to a respective group of magnetic cores 38 different from and independent of the magnetic cores 38 associated with activating members 35 and 36.

In the embodiment shown in the accompanying drawings, fixed magnetic cores 38 are located, and only heat activating members 35, 36, 37, along a limited portion of the packing path travelled by folding heads 22. Each activating member 35, 36, 37 has a low thermal inertia, so that, each time it travels along the packing path, activating member 35, 36, 37 has a temperature T1 when supplied with electric current C2, and a temperature T2, much lower than temperature T1 and close to ambient temperature, when not supplied with electric current C2. In other words, the thermal inertia of each activating member 35, 36, 37 is low enough for it to heat and cool much faster than the time taken by packing wheel 21 to make one complete turn about its central axis.

As described above, one end of inland revenue stamp 7 is heated by activating member 36 housed inside suction plate 31; the opposite end of inland revenue stamp 7 is preferably heated by a stream of hot air produced by fans (not shown) located in fixed positions along the packing path, or by infrared rays emitted by lamps (not shown) located in fixed positions along the packing path.

Figure 4:
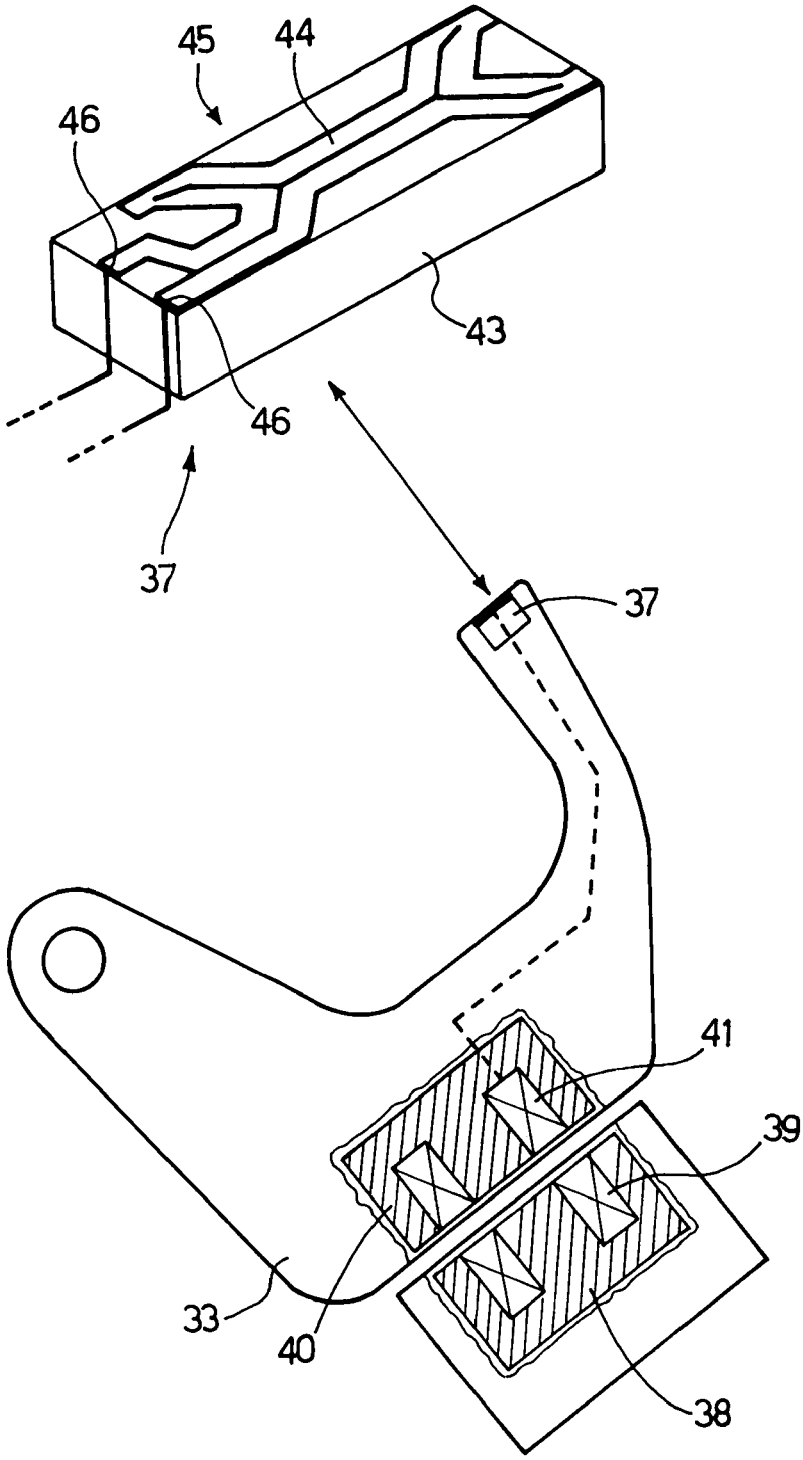
FIG. 4 shows a plan view of a folding device of the FIG. 2 folding head.

FIG. 4 shows a more detailed view of activating member 37 of end folding device 33, which comprises a supporting pad 43 made of thermal insulating material (in particular, silicone rubber); and a thin plate 44 supported on pad 43 and made of electrically and thermally conducting material (in particular, metal). Plate 44 defines a heating surface, and extends along a work path 45 having two ends 46. Work path 45 is shaped to reproduce the arrangement of overlapping areas of parts of sheet 6 of packing material, so as to concentrate the heat produced by plate 44 on the overlapping areas of sheet 6 on which thermoplastic glue has been deposited. It should be pointed out that the other activating members 35, 36 are also formed in exactly the same way as activating member 37 described above.

In an embodiment not shown, the cross section area of plate 44 varies along work path 45. More specifically, the area of each cross section of plate 44 depends on, and is inversely proportional to, the amount of heat to be produced at that particular cross section. Alternatively, the cross section area of plate 44 is constant, and the width of plate 44 varies along work path 45.

One possible embodiment comprises a control unit 47 for determining the mean temperature of activating members 35, 36, 37 when they are powered electrically, and for controlling power supply device 42 to vary the intensity of electric current C1 as a function of the mean temperature of activating members 35, 36, 37. More specifically, the purpose of control unit 47 is to ensure activating members 35, 36, 37, when powered electrically, reach a given mean temperature, which normally depends on the physical characteristics of the thermoplastic glue employed, the physical characteristics of sheet 6 of packing material, and possibly also the rotation speed of packing wheel 21.

For example, control unit 47 determines the mean temperature of activating members 35, 36, 37 by determining a mean electric resistance value of activating members 35, 36, 37, in turn determined by determining the equivalent impedance of coils 41 seen by coils 39.

Control unit 47 may also vary the length of time activating members 35, 36, 37 are powered electrically, by varying the number of coils 39 of fixed magnetic cores 38 which are actually powered. In other words, for a given rotation speed of packing wheel 21, the greater the number of coils 39 that are powered, the longer activating members 35, 36, 37 will be powered electrically. This control method is adopted by control unit 47 to ensure the length of time activating members 35, 36, 37 are powered electrically is maintained constant alongside variations in the rotation speed of packing wheel 21.

In another embodiment not shown, fixed magnetic cores 38 are located, and heat activating members 35, 36, 37, along the whole of the packing path travelled by folding heads 22.

In actual use, as packing wheel 21 rotates continuously about a central axis perpendicular to the FIG. 1 plane, each packing head 22 is fed cyclically along a circular packing path, along which packing head 22 receives a respective sheet 6 of packing material and an inland revenue stamp 7 from supply station 9*d*, receives a respective group 3 of cigarettes from packing wheel 16, and folds sheet 6 of packing material and inland revenue stamp 7 about group 3 of cigarettes. Each sheet 6 of packing material and the respective inland revenue stamp 7 are gummed with thermoplastic (or hot-melt) glue by gumming device 26 before being fed to packing wheel 21, i.e. gumming device 26 deposits on each sheet 6 of packing material and on the respective inland revenue stamp 7 a number of spots and/or bands of thermoplastic glue on the overlap areas of sheet 6 of packing material and inland revenue stamp 7. Before each sheet 6 of packing material and the respective inland revenue stamp 7 are folded about group 3 of cigarettes, the thermoplastic glue deposited by gumming device 26 sets on cooling and so becomes ineffective. And, once each sheet 6 of packing material and the respective inland revenue stamp 7 are folded about group 3 of cigarettes, heat is applied to respective packet 2 to heat the thermoplastic glue on sheet 6 of packing material and on inland revenue stamp 7, and so reactivate and restore the thermoplastic glue to the liquid or semiliquid state.

In other words, each sheet 6 of packing material and the respective inland revenue stamp 7 are gummed by gumming device 26 applying thermoplastic glue, which sets on cooling before sheet 6 of packing material and respective inland revenue stamp 7 are folded; and sheet 6 of packing material and inland revenue stamp 7 are then fed to a respective folding head 22, where they are combined with relative group 3 of cigarettes. Lateral folding devices 32 and end folding device 33 of folding head 22 are moved into contact with respective walls of group 3 of cigarettes to fold respective portions of sheet 6 of packing material onto the walls of the group to form a corresponding packet 2; and packet 2 is then heated to reactivate the thermoplastic glue by means of activating members 35, 36, 37, some of which are carried by lateral folding devices 32 and end folding device 33 contacting the walls of packet 2. Activating members 35, 36, 37 are initially at temperature T2, close to ambient temperature, when sheet 6 of packing material is folded, are subsequently powered electrically to reach and remain at temperature T1 long enough to reactivate the thermoplastic glue, and are finally cut off from the power supply to return rapidly, by virtue of their low thermal inertia, to temperature T2 to allow the thermoplastic glue to set once more. Only when the thermoplastic glue is set hard enough is packet 2 released from folding head 22, thus preventing any springback of sheet 6 of packing material or inland revenue stamp 7 when packet 2 leaves folding head 22.

Clearly, the construction design solution described above for electrically powering heating members carried on a moving conveyor may also be applied to other automatic packing machines, such as cellophaning machines, in which the heating members heat seal sheets of transparent plastic packing material.

The invention claimed is:

1. A packing machine for producing a package (2) by folding a sheet (6) of packing material about a respective article (3); the packing machine (1) comprising a conveyor (21) having at least one seat (22), which feeds the package (2) along a packing path, and has at least one electrically heatable activating member (35, 36, 37) for applying heat to a portion of the package (2); the packing machine (1) being characterized by comprising a number of fixed first magnetic cores (38), each having a respective first coil (39) and positioned parallel to the conveyor (21) along a portion of the packing path; the seat (22) comprising a respective movable second magnetic core (40), which has a second coil (41) connected electrically to the activating member (35, 36, 37), and is positioned facing and coupled magnetically to the fixed first magnetic cores (38); a power supply device (42) being provided, which, in use, supplies the first coils with a first electric current (C1) to induce flow of a corresponding second electric current (C2) through the second coil (41).

2. A packing machine as claimed in claim 1, wherein the fixed first magnetic cores (38) are located along a limited portion of the packing path.

3. A packing machine as claimed in claim 1, wherein the activating member (35, 36, 37) has a low thermal inertia, so that, each time it travels along the packing path, the activating member (35, 36, 37) has a first temperature (T1) when the second electric current (C2) flows through the activating member (35, 36, 37), and a second temperature (T2), much lower than the first temperature (T1) and close to ambient temperature, when the second electric current (C2) does not flow through the activating member (35, 36, 37).

4. A packing machine as claimed in claim 3, wherein the activating member (35, 36, 37) comprises a supporting pad (43) made of thermally insulating material; and a plate (44), which is supported on the pad (43), is made of electrically and thermally conducting material, and comprises a thin plate (44) extending along a work path (45) having two ends (46) connected electrically to the second coil (41).

5. A packing machine as claimed in claim 4, and comprising a gumming unit (26) located upstream from the conveyor (21) and for gumming the sheet (6) of packing material by applying hot-melt glue, which is subsequently reactivated by the heat produced by the activating member (35, 36, 37); the work path (45) reproducing the arrangement of glue spots on the overlap areas of the sheet (6) of packing material.

6. A packing machine as claimed in claim 4, wherein the plate (44) has a cross section varying from one point to another of the work path (45).

7. A packing machine as claimed in claim 1, and comprising a control unit (47) for determining the temperature of the activating member (35, 36, 37), and for controlling the power supply device (42) to vary the intensity of the first electric current (C1) as a function of the temperature of the activating member (35, 36, 37).

8. A packing machine as claimed in claim 7, wherein the control unit (47) determines the temperature of the activating member (35, 36, 37) by determining an electric resistance value of the activating member (35, 36, 37).

9. A packing machine as claimed in claim 8, wherein the control unit (47) determines the electric resistance value of the activating member (35, 36, 37) by determining the equivalent impedance value of the second coil (41) seen by the first coil (39).

10. A packing machine as claimed in claim 1, and comprising a gumming unit (26) located upstream from the conveyor (21) and for gumming the sheet (6) of packing material by applying hot-melt glue, which is subsequently reactivated by the heat produced by the activating member (35, 37); the seat (22) comprising a movable folding device (32, 33), which houses the activating member (35, 37) and is movable into a position contacting a wall of the article (3) to fold a portion of the sheet (6) of packing material onto the wall of the article (3); the activating member (35, 37) having a low thermal inertia, so that, each time it travels along the packing path, the activating member (35, 37) has a first temperature (T1) when the second electric current (C2) flows through the activating member (35, 37), and a second temperature (T2), much lower than the first temperature (T1) and close to ambient temperature, when the second electric current (C2) does not flow through the activating member (35, 37); the folding device (32, 33) being moved into contact with the sheet (6) of packing material when the activating member (35, 37) is at the second temperature (T2); the folding device (32, 33) being moved into contact with the wall of the article (3) to fold a portion of the sheet (6) of packing material onto the wall of the article (3); the activating member (35, 37) being heated electrically, so that the activating member (35, 37) assumes the first temperature (T1) long enough to reactivate the glue; the electric power supply being cut off from the activating member (35, 37) to restore the activating member (35, 37) to the second temperature (T2) and allow the glue to set once more; and, finally, the package (2) being released from the seat (22).

* * * * *